US008997992B2

(12) United States Patent
Van Puijenbroek

(10) Patent No.: US 8,997,992 B2
(45) Date of Patent: Apr. 7, 2015

(54) PACKAGE FOR FLOWABLE GOODS, IN PARTICULAR COMESTIBLES, AND USE OF SUCH PACKAGE DURING TRANSPORTATION, PRESENTATION AND CONSUMPTION

(75) Inventor: Alexander Josephus Marcius Van Puijenbroek, Den Bosch (NL)

(73) Assignee: N.V. Nutricia (NL)

( * ) Notice: Subject to any disclaimer, the term of this patent is extended or adjusted under 35 U.S.C. 154(b) by 811 days.

(21) Appl. No.: 12/497,267

(22) Filed: Jul. 2, 2009

(65) Prior Publication Data

US 2009/0301923 A1 Dec. 10, 2009

Related U.S. Application Data

(63) Continuation of application No. PCT/NL2008/050011, filed on Jan. 8, 2008.

(30) Foreign Application Priority Data

Jan. 8, 2007 (EP) ..... 07075013

(51) Int. Cl.
*B65D 1/22* (2006.01)

(52) U.S. Cl.
CPC ..... *B65D 1/22* (2013.01); *B65D 2207/00* (2013.01)

(58) Field of Classification Search
CPC ..... B65D 1/22; B65D 2207/00
USPC ..... 220/605, 608, 604, 606, 669, 657; 206/505, 524.6, 223; 426/106, 112; D9/414, 424, 425, 428, 432; D7/601, D7/602, 605, 629
See application file for complete search history.

(56) References Cited

U.S. PATENT DOCUMENTS 3,407,969 A 10/1968 Klein et al.
3,913,734 A * 10/1975 Siegel ..... 206/470

(Continued)

FOREIGN PATENT DOCUMENTS

DE 8215495.3 U1 8/1982
DE 10142788 A1 3/2003

(Continued)

OTHER PUBLICATIONS

International Preliminary Examining Report for corresponding PCT 2008/050011.

*Primary Examiner* — Robert J Hicks
*Assistant Examiner* — Kareen Rush
(74) *Attorney, Agent, or Firm* — Banner & Witcoff, Ltd.

(57) ABSTRACT

The invention relates to a package for flowable goods, in particular liquid, viscous and/or granular comestibles, such as baby food, pudding, sauce, oatmeal or the like. The package comprises a shallow tray and a cover which in closed condition slants towards a bottom wall of the tray thereby providing the package with a substantially wedge-shaped appearance. The package furthermore comprises two support faces to stand on alternately. A first support face is located at the bottom wall of the tray and a second support face is located at a bottom-surrounding wall of the tray, at the higher end of the wedge.

Figure 1A:
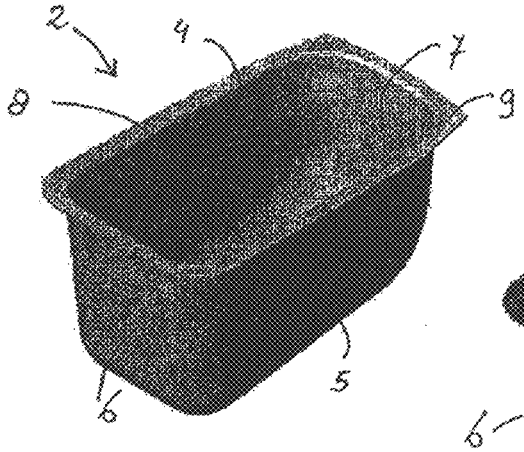

During use, the package can be positioned on its second support face for presentation purposes, on its first support face for consumption purposes. During transport, pairs of packages may placed with their slanting covers against each other, in opposite lengthwise direction so that a high end of a wedge-shaped first package borders a low end of a wedge-shaped second package.

18 Claims, 3 Drawing Sheets

(56) References Cited

U.S. PATENT DOCUMENTS

| | | | | | |
|---|---|---|---|---|---|
| D241,014 | S | * | 8/1976 | Barnhart | D9/425 |
| 4,301,926 | A | * | 11/1981 | Chung | 229/103.1 |
| 4,545,783 | A | * | 10/1985 | Vaughan | 604/259 |
| 4,798,324 | A | * | 1/1989 | Gannon | 229/125.35 |
| D349,050 | S | * | 7/1994 | Krupa | D9/425 |
| 5,390,817 | A | * | 2/1995 | Rosen | 220/669 |
| D388,324 | S | * | 12/1997 | Bonnard | D9/424 |
| D400,099 | S | * | 10/1998 | Brauner et al. | D9/431 |
| 5,839,609 | A | * | 11/1998 | Zakensberg | 222/107 |
| 6,027,695 | A | | 2/2000 | Oldenburg et al. | |
| 6,297,018 | B1 | | 10/2001 | French et al. | |
| 6,585,123 | B1 | * | 7/2003 | Pedmo et al. | 215/10 |
| D541,110 | S | * | 4/2007 | Wasserman et al. | D7/584 |
| 2002/0187074 | A1 | | 12/2002 | O'Connor et al. | |
| 2003/0017079 | A1 | | 1/2003 | Hahn et al. | |
| 2004/0080744 | A1 | | 4/2004 | Hobbs | |
| 2004/0165186 | A1 | | 8/2004 | Bjornson et al. | |
| 2004/0203174 | A1 | | 10/2004 | Jones et al. | |
| 2007/0164045 | A1 | * | 7/2007 | Wydler et al. | 222/106 |
| 2011/0147260 | A1 | * | 6/2011 | Perchtold et al. | 206/524.6 |

FOREIGN PATENT DOCUMENTS

| | | | |
|---|---|---|---|
| DE | 10321472 | A1 | 12/2004 |
| FR | 1437667 | | 3/1966 |
| FR | 2058493 | A5 | 5/1971 |
| WO | 9717264 | A1 | 5/1997 |
| WO | 9944217 | A1 | 9/1999 |
| WO | 02066337 | A2 | 8/2002 |
| WO | 2005073691 | A1 | 8/2005 |
| WO | 2006098696 | A1 | 9/2006 |
| WO | 2008085041 | A1 | 7/2008 |

* cited by examiner

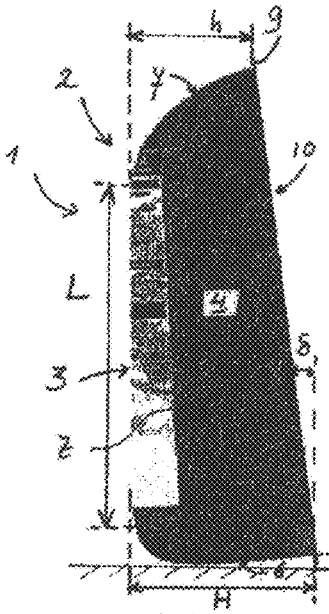
FIG. 2A
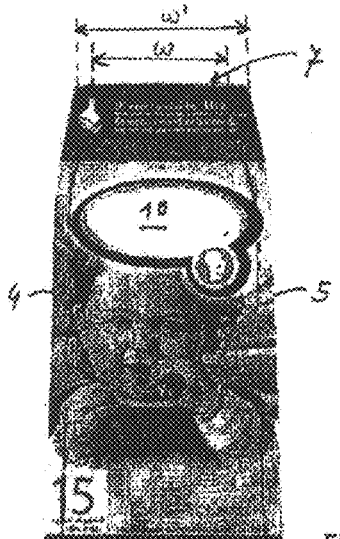
FIG. 2B
FIG. 2C
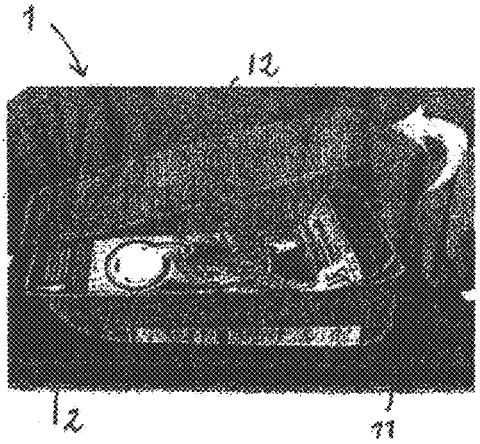
FIG. 3A
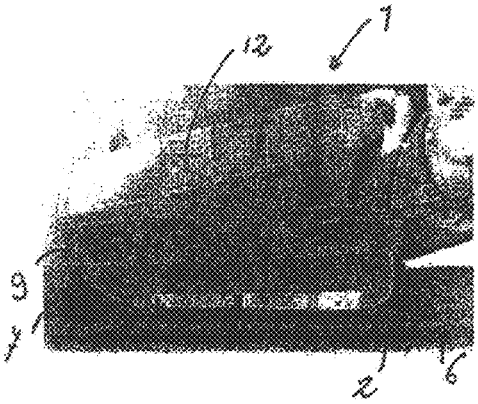
FIG. 3B

PACKAGE FOR FLOWABLE GOODS, IN PARTICULAR COMESTIBLES, AND USE OF SUCH PACKAGE DURING TRANSPORTATION, PRESENTATION AND CONSUMPTION

RELATED APPLICATIONS

This application is a continuation of PCT/NL2008/050011, designating the United States and filed Jan. 8, 2008, which claims the benefit of the filing date of European Application No. 07075013.8 filed Jan. 8, 2007; each of which is hereby incorporated herein by reference in the entirety for all purposes.

The invention relates to a package for flowable goods, in particular liquid, viscous and/or granular comestibles, such as baby food, pudding, instant sauce, oatmeal or the like.

BACKGROUND

Typically, this genre of food is sold in glass jars. Such jars offer several advantages. For one, they form appropriate transport and presentation means, as they can be stacked in a stable manner and in such stacked condition offer a good view on the contents or a label that may be wrapped around the jar. Furthermore, the food can be sterilized directly in the jar. Also, the food can be made ready for consumption in the jar, for instance by heating the jar au-bain-marie or in a microwave, and can subsequently be served directly from the jar.

Notwithstanding these advantages, the known jars also exhibit some disadvantages. For instance, they are difficult to empty completely. Especially the edges near the bottom and around the opening may be hard to access. Also, the jars may be relatively heavy, thereby adding to transportation costs. In addition, if hazards occur during manufacture, residual glass material may contaminate the product thus causing a health risk for the consumer.

SUMMARY

It is therefore an object of the invention to provide an improved container for the above described food, wherein at least part of the disadvantages of the conventional jars are overcome, while at least part of the advantages thereof are maintained. To that end a package according to the invention is characterized by the features of claim 1.

Such package can be advantageously used in different ways. For consumption of the contents, the tray can be placed on its first support face. In this first position the package will have a very stable position, thanks to the shallow depth of the tray (as viewed in a direction perpendicular to the bottom wall) and consequently its low centre of gravity. The tray's shallow depth moreover makes the contents readily accessible. The slanting topside will render the access opening even better accessible. For presentation purposes of the closed package, the package may be placed on its second support face on a shelf or the like. In this second position, the closing cover of the package slants slightly backward with regard to a vertical plane, thereby offering an excellent viewing angle on its surface. Hence, said cover surface may be advantageously printed with product information for a potential consumer. Additionally, at least part of the cover may be transparent, so as to allow inspection of the contents. The wedge-shaped design furthermore shifts the centre of gravity to the second support face, thereby enhancing stability in this second position. The bottom wall is of elongated shape, surrounded by two sidewalls and two end walls, wherein a first end wall is higher than the second end wall and forms part of the second support face. Thanks to such design, the volume at the top of the package (when said package is positioned at its second support face) will be smaller than the volume at the bottom of the package. This may help to keep the centre of gravity of the package at a relatively low, stable position. By providing a radius of curvature between the second end wall and the bottom wall that is larger than a radius of curvature between the first end wall and the bottom wall, wherein the radius of curvature between the first end wall and the bottom wall ranges between about 5-30 mm, more preferably between about 7-25 mm and most preferably between about 8-20 mm, whereas the radius of curvature between the second end wall and the bottom wall ranges between about 10-40 mm, more preferably between about 15-32 mm and most preferably between about 18-30 mm, the volume at the top of the package can even be further reduced as compared to the volume at the bottom of the package, thereby enhancing the stability of the package even further when standing at its second support face. Moreover, this allows the width of the package or at least of the cover to be kept substantially constant over the length of the cover, thereby ensuring a good, sufficiently large presentation surface. The relatively large radius of curvature between the bottom wall and the second end wall may furthermore help to pour out the tray contents more easily.

According to one aspect of the invention, the tray may have rounded corners, at least at its interior. This may facilitate emptying of the tray and nesting of the empty packages before filling. To this end, the radius of curvature of said interior corners preferably is at least 5 mm. The external shape of the package may feature more angular corners, for instance to help supporting the package in a stable position.

According to another aspect of the invention, the tray's access opening may be surrounded by a flange. Such flange may serve as a support base for the cover, which may be clamped, sealed or otherwise attached to the flange. The flange can be directed to the outside or to the inside of the packaging. The flange, especially an edge portion thereof, may furthermore form part of the second support face. This edge portion is preferably straight. The distance over which this edge portion projects from the tray and the tray height (measured perpendicular to the bottom wall) together influence the extent to which the package inclines backward, when placed at its second surface, and as such help to determine the stability of the package in said position. Preferably, said projecting distance and tray height are dimensioned such that the second support face (or a plane defined thereby) extends substantially perpendicular to the bottom wall of the tray. This will ensure that the projection of the centre of gravity lies within the footprint of the second support face, which in turn will ensure good stability when the package is placed at said second face.

According to a further aspect of the invention, the tray may be closed by a sheet and/or a lid. The sheet and/or lid may be sealed against a rim of the tray, around the access opening, and thus provide for an airtight and tamperproof closure. Alternatively, the lid may be clamped around the access opening, preferably in a re-closable manner, so as to allow the package to be closed after use. When both a sheet and lid are used to close the package, the lid may serve to protect the sheet against tearing or being punctured.

In an alternative embodiment the sheet and/or lid may be extended so as to cover at least part of the bottom surrounding wall of the tray and thus form at least part of the second support face of the package.

According to yet another aspect of the invention, the tray may be of nestable design. This allows a series of such (empty) trays to be stacked compactly, one in the other, before filling at a production line.

In further elaboration, the sidewalls may taper to each other in a direction from the first to the second end wall, over at least part of their length. Such tapering shape will help to shift the centre of gravity towards the first end wall, thereby increasing stability of the package when positioned at the second support face.

According to another aspect of the invention, the package may have a length (measured in longitudinal direction of the bottom wall) which is maximum four times the maximum height of the package (measured perpendicular to the bottom wall) and more preferably maximum 3.5 times said maximum height. This will prevent the package from tipping over, when positioned on its second support face.

The package according to the invention can for instance be made of plastic or metal, for instance by thermoforming.

The invention furthermore relates to the use of a package according to the invention, for presentation, transport and consumption purposes, according to the features of claim 17. Thanks to such features the package offers good stability and accessibility for consumption purposes, good stability and visibility for presentation purposes, compact nesting before filling and compact stacking after filling, during transport.

It is noted that DE 82,15,495 discloses a package for food articles. The package comprises a shallow tray and a cover which in closed condition slants towards a bottom wall of the tray thereby providing the package with a substantially wedge shaped appearance. The tray comprises two support faces, on which the package can be placed alternately, a first support face being formed at the bottom wall of the tray and a second support face being formed at a bottom surrounding wall of the tray and/or the cover. The bottom wall is of elongated shape, surrounded by two sidewalls and two end walls, wherein a first end wall is higher than the second end wall and forms part of the second support face. With such a package the centre of gravity is displaced towards the first end wall thereby providing a stable package when it is placed in straight up position. Further advantageous embodiments of a package according to the present invention and the use thereof are set forth in the dependent claims.

DETAILED DESCRIPTION

Figure 1B:
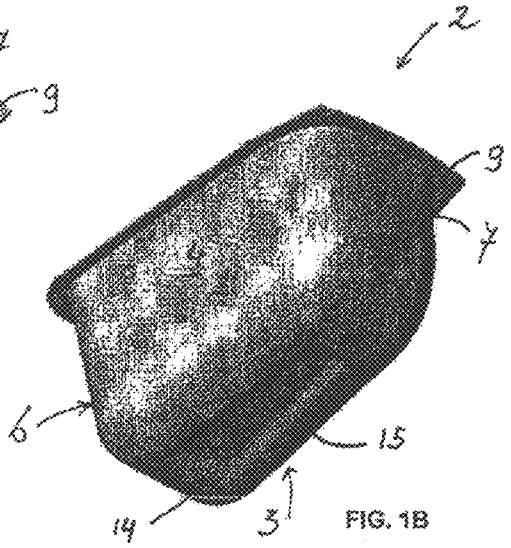
Figure 1C:
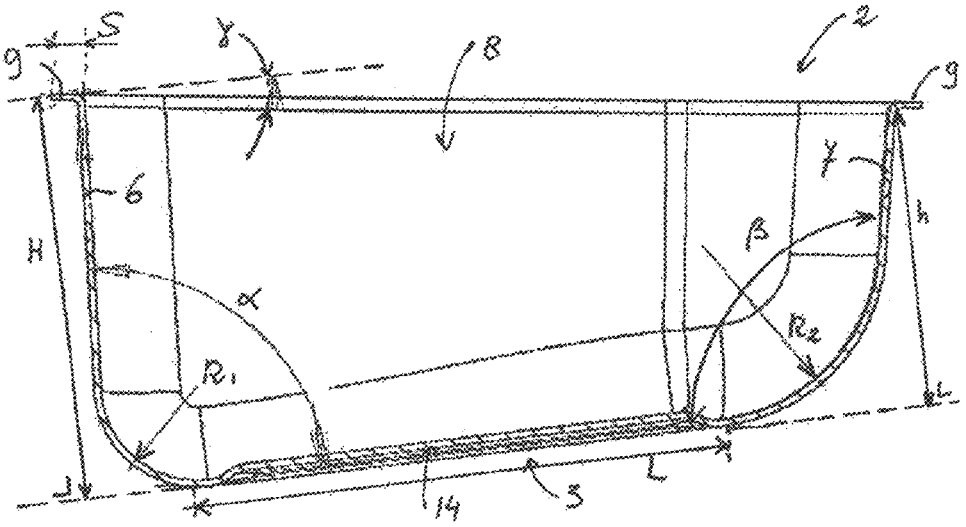
Figure 4:
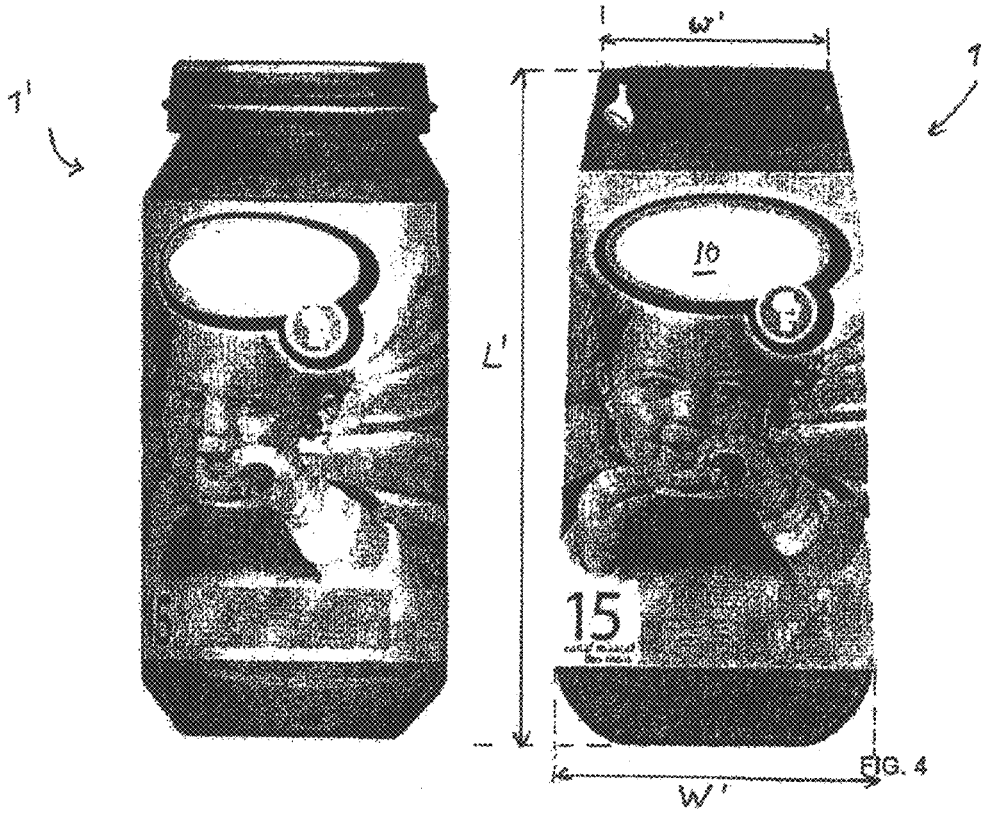
Figure 5:
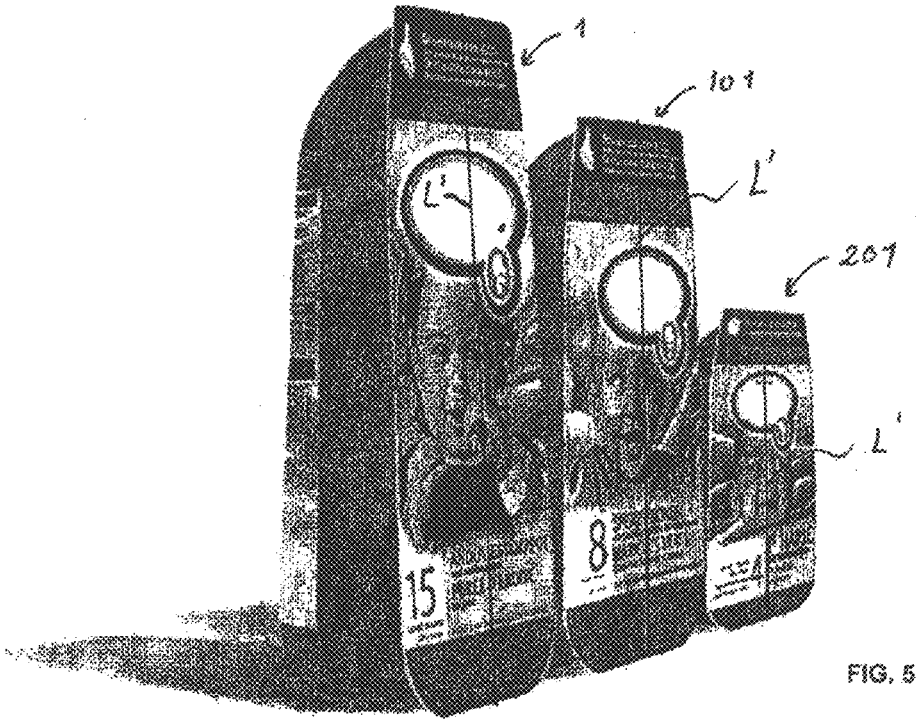

To explain the invention, an exemplary embodiment thereof will hereinafter be described with reference to the accompanying drawings, wherein:

FIGS. 1A-C show an embodiment of the tray of a package according to the invention, in perspective top view, perspective bottom view and longitudinal cross section, respectively;

FIGS. 2A-C show a package according to the invention, in side view, frontal view and end view, respectively;

FIGS. 3A,B show the package of FIG. 2, placed at its bottom wall;

FIG. 4 shows a prior art package and the package of FIG. 2, placed at its first end wall; and FIG. 5 shows a series of packages according to the invention, in presentation position.

The package 1 according to the invention comprises a tray 2 with a bottom wall 3, two sidewalls 4, 5, two end walls 6, 7 and an open top side or access opening 8. The access opening 8 is in the given embodiment surrounded by a flange 9, which projects outward from the sidewalls 4, 5 and the end walls 6, 7 and forms a support surface for a closing cover 10. This closing cover 10 may comprise a sheet 11 (as seen in FIG. 3A) and/or a re-closable lid 12 (as seen in FIGS. 3A and B). The lid 12 may serve to protect the closing sheet 11 against puncturing, tearing or other damage and may furthermore serve to re-close the tray after removal of the sheet 11. Of course, in alternative embodiments, the cover 10 may only comprise a sheet 11 or a lid 12. The sheet 11 and lid 12 may also co-operate to form a tamper-evident closure.

In the embodiment according to FIGS. 1 and 2, the bottom wall 3 is substantially rectangular, with one of its short sides bordering a first end wall 6 and the opposite short side bordering a second end wall 7. In other embodiments the bottom wall 3 could for instance be trapezium shaped or oval. As depicted in FIGS. 1B and C, the bottom wall 3 may be provided with an embossed centre portion 14. This may increase the wall stiffness as well as improve the stability of the tray 2, as the surrounding wall portion 15 will provide for a stable support surface.

The first end wall 6 has a height H (measured perpendicular to the bottom wall 3) that is larger than the height h of the second end wall 7 (see FIGS. 1C and 2A). As a consequence, the open topside 8 of the tray 2 and its surrounding flange 9 will slant (Y) towards the bottom wall 3.

The first end wall 6 furthermore includes an angle $\alpha$ with the bottom wall 3 which in the given example is slightly smaller than 90°, for instance between 80° and 89°. In FIG. 1C the angle $\alpha$ is shown to be 86°. The second end wall 7 includes an angle $\beta$ with the bottom wall 3 which is slightly larger than 90° and preferably so large that the first and second end wall 6, 7 diverge with respect to one another (as seen in a direction away from the bottom wall 3). To that end, the angle $\beta$ may for instance range between 92° and 120°, so as to produce a divergence between about 1° to 10°. In FIG. 1C the angle $\beta$ is shown to be 111°. Thanks to such divergence the container 3 will be readily nestable.

The first end wall 6 may furthermore have a width W which near the access opening 8 of the tray is larger than the width w of the second end wall 7 (which in FIG. 2B has been shown in underbroken lines). Accordingly, the access opening 8 may have a trapezoid shape. Ditto for the flange 9 (of which the width is indicated by W' and w' in FIG. 2B). In such case, the sidewalls 4, 5 may taper or bend inward from the first end wall 6 to the second end wall 7.

The afore described package 1 can be positioned on its bottom side, as shown in FIGS. 3A and B, in which case the ring shaped portion 15 of the bottom wall 3 forms a stable first support surface. The package 1 can furthermore be positioned at the high end of the wedge, as shown in FIGS. 2A, 4 and 5, in which case the first end wall 6 and the projecting flange 9 co-operate to form a stable second support face. The flange 9 may thereto comprise a straight edge. As may be seen from FIG. 2A, the amount of projection S of the flange 9 with regard to the first end wall 6 will affect the orientation and stability of the package 1 when placed at said second support face. If S is increased, the package 1 will tilt backward (counterclockwise in FIG. 2A) causing the centre of gravity Z to shift to the left as well, closer towards the boundary of the second support face. This will make the package 1 more instable. Therefore, according to a preferred embodiment, the amount of projection S of the flange 9 is preferably selected such that the second support face includes an angle of about 90° with the bottom wall 3 of the tray 2. The stability of the package 1 in its second position (i.e. on its second support face) may further or alternatively be enhanced by limiting the length L, L' of the package 1 as measured along the bottom wall 3, respectively the cover 10. By limiting this length to about maximum 3.5 to 4 times the height H of the first end wall 6, the package 1 will be less prone to tip over. This length L, L' may furthermore be used to control the volume of the package 1 and to produce packages of different volumes, as shown in FIG. 5. Of course, this can alternatively be achieved by changing the height and/or depth, or all three of them.

The stability of the package 1 in its second position can also or alternatively be enhanced by increasing the slanting angle γ of the top side 8,10 of the tray 2 and/or by increasing the amount over which the side walls 4, 5 taper towards the second end wall 7, since both effects will cause the centre of gravity Z to shift downward, towards the first end wall 6.

More generally speaking the tapering and slanting design of the package 1 is preferably such that the projection of the centre of gravity Z onto the first and second support faces respectively, lies well within the boundaries or footprint of said support faces. Furthermore, the design may be such, that the centre of gravity Z lies somewhat closer to the first and second support face respectively, than to the opposite faces of the package 2.

Of course, the abovementioned stability influencing parameters can all cooperate together to provide a stable package. The projection S of the flange 9 and the slanted configuration γ of the top side 8,10 of the tray can for instance be selected such that when the package 1 is placed at its second support face, the top side 8,10 includes an angle δ with the vertical plane (as shown in FIG. 2A) which ranges from about 3° to 30°, more particularly from about 4° to 20° and most preferably from about 5° to 10°. In the illustrated embodiment said angle δ is shown to be about 7.5°. In the illustrated embodiment angle δ (defined with regard to the vertical plane) is furthermore shown to be equal to angle γ (defined with regard to the bottom wall 3), but this need not be the case in other embodiments.

Besides improved stability, as explained above, the slanted top side of the tray 2 moreover offers a good view on the cover 10, when the package 1 is placed on its second support face (FIG. 2A). Hence, in this second position, the package 1 possess similar presentation qualities as the conventional jar, i.e. good stability and a good view on the tray's contents and/or label, as is especially apparent from FIG. 4, showing a conventional jar on the left side and a package 1 according to the invention on the right side. However, in comparison to the conventional jar, the package 1 offers a far better accessibility to the package contents, when placed at its first support face (FIGS. 3A,B) thanks to the shallow depth H,h, the large access opening 8 and the slanting upper rim. Also, during transport, the packages 1 according to the invention can be stacked in a rather compact fashion, by placing pairs of trays 2 against each other with their slanting covers 10, and with a low end of one wedge against the high end of the other wedge. Thus the pair of trays together will have a substantially parallelepiped shape.

Although the above described package 1 has been shown in combination with baby food, it will be clear that the package 1 may be used for different types of foods, in particular foods with a 'flowable' character, i.e. which shift their position when the orientation of the package 1 is changed.

The invention is not in any way limited to the exemplary embodiments presented in the description and drawing. All combinations (of parts) of the embodiments shown and described are explicitly understood to be incorporated within this description and are explicitly understood to fall within the scope of the invention. Moreover, many variations are possible within the scope of the invention, as outlined by the claims.

The invention claimed is:

1. Package for flowable goods, the package having a height and comprising a shallow tray, an opening, a flange at the opening and a cover which in closed condition slants towards a bottom wall of the tray thereby providing the package with a substantially wedge-shaped appearance, the package furthermore comprising two support faces, on which the package can be placed alternately, a first support face comprising the bottom wall of the tray and a second support face comprising a bottom surrounding wall of the tray near a high end of the wedge-shaped package and the flange, with the height (H) being defined in a direction perpendicular to the bottom wall, wherein the bottom wall is of elongated shape, surrounded by two sidewalls and two end walls, wherein a first end wall is higher than the second end wall and forms part of the second support face, characterized in that a radius of curvature (R2) between the second end wall and the bottom wall is larger than a radius of curvature (R1) between the first end wall and the bottom wall, wherein the radius of curvature (R1) between the first end wall and the bottom wall ranges between about 5-30 mm and the first end wall or a tangent plane thereof includes an angle (α) with the bottom wall which is smaller than 90° and the flange projects an amount (S) from the first end wall such that the cover is slanted backward and the bottom wall extends substantially perpendicular to the second support face when the package is placed on its second support face, whereas the radius of curvature (R2) between the second end wall and the bottom wall ranges between about 10-40 mm, and the first end wall and second end wall diverge from one another such that the tray is of nestable design, so that a series of such empty trays can be nested one into the other.

2. Package according to claim 1, wherein the tray has rounded corners, at least at its interior.

3. Package according to claim 1, wherein the opening of the tray is surrounded by the flange.

4. Package according to claim 3, wherein the flange projects outwardly from the tray.

5. Package according to claim 3, wherein the second support face is formed by a part of the bottom surrounding wall and a part of the flange.

6. Package according to claim 1, wherein the cover comprises a sheet, which in closed condition is sealed against an upper tray rim, surrounding an access opening of the tray.

7. Package according to claim 1, wherein the cover comprises a lid, which in closed condition is clamped around an upper tray rim, surrounding an access opening of the tray.

8. Package according to claim 1, wherein the the second end wall or a tangent thereof includes an angle (β) with the bottom wall which is greater than 90°.

9. Package according to claim 1, wherein the second end wall or a tangent plane thereof diverges with respect to the first end wall, in a direction away from the bottom wall.

10. Package according to claim 1, wherein the second end wall has a concave shape, as seen from the inside of the tray.

11. Package according to claim 1, wherein the sidewalls taper to each other in a direction from the first to the second end wall, over at least part of their length.

12. Package according to claim 1, wherein the surface of an open topside of the container is larger than the surface of the bottom wall.

13. Package according to claim 1, wherein a maximum height of the package, measured perpendicular to the bottom wall, is of the same magnitude as, or smaller than a maximum width of the package, measured in lateral direction of the bottom wall.

14. Package according to claim 1, wherein a maximum length of the package, measured in longitudinal direction of the bottom wall is maximum four times the maximum height of the package, measured perpendicular to the bottom wall.

15. Use of a package according to claim 1, wherein for presentation purposes the package is placed at its second support face, for consumption purposes the package is placed at its first support face and for transportation purposes, the package is paired with another package of claim 1 with their slanting covers against each other, in opposite lengthwise direction so that a low end of a first wedge-shaped package borders a high end of a second wedge-shaped package.

16. Package according to claim 1, wherein the first end wall or a tangent plane thereof includes an angle ($\alpha$) with the bottom wall which ranges between about 80° and 89°.

17. Package according to claim 1 wherein the flowable good is a liquid, viscous or granular comestible.

18. Package according to claim 1 wherein the flowable good is baby food, pudding, sauce, or oatmeal.

* * * * *